United States Patent [19]

Kangas et al.

[11] Patent Number: 4,843,650

[45] Date of Patent: Jul. 4, 1989

[54] PROTECTIVE GLOVE

[76] Inventors: Lawrence W. Kangas, 4 Alisha Dr., Franklin, Mass. 02038; Ross E. MacDonald, 514 N. Washington St., North Attleboro, Mass. 02760

[21] Appl. No.: 142,061

[22] Filed: Jan. 11, 1988

[51] Int. Cl.[4] ..... A41D 19/00

[52] U.S. Cl. ..... 2/159; 2/161 R; 2/161 A; 2/162; 2/167

[58] Field of Search ..... 2/159, 161 R, 161 A, 2/162, 167

[56] References Cited

U.S. PATENT DOCUMENTS

| | | | |
|---|---|---|---|
| 373,470 | 11/1887 | Morrison | 2/162 |
| 752,769 | 2/1904 | Graichen | 2/162 |
| 948,615 | 2/1910 | Pratt | 140/3 B |
| 1,028,904 | 6/1912 | Pratt | 140/3 B |
| 1,736,928 | 11/1929 | Lowe | 2/167 |
| 4,004,295 | 1/1977 | Byrnes | 2/167 |
| 4,471,495 | 9/1984 | Kruse et al. | 2/162 |
| 4,750,218 | 6/1988 | Ziegler | 2/167 X |

*Primary Examiner*—Werner H. Schroeder
*Assistant Examiner*—D. Biefeld
*Attorney, Agent, or Firm*—Hale and Dorr

[57] ABSTRACT

Disclosed is a protective metal mesh glove that has no side opening, yet has a wide enough opening for the hand of the user to fit inside. A V-shaped portion of metal mesh is secured to the sides of the slit to enclose a wearer's hand with metal mesh. When a closure strap is opened, the V-shaped portion extends to its full V-shape. When the glove is fastened by tightening and securing the strap, the upper tips of the V-shaped section overlap each other, thereby securely and completely closing the glove.

8 Claims, 2 Drawing Sheets

PROTECTIVE GLOVE

BACKGROUND OF THE INVENTION

The present invention relates to protective gloves, and more particularly to protective gloves designed for use by pathologists performing autopsies.

Due to the recent spread of Acquired Immune Deficiency Syndrome (AIDS), pathologists have become reluctant to perform autopsies on bodies of people believed to have died from AIDS. While rubber gloves will in all likelihood prevent the spread of the disease from the dead body to the pathologist, such gloves have been known to rip when in contact with a scalpel or other sharp instrument in which case the sharp instrument frequently pierces the hand of the pathologist as well. As a result, any protective glove worn by pathologists must be strong enough to prevent accidental injury to the wearer from knives and other sharp instruments. They should also resist absorption of fluids such as blood, be able to withstand sterilizing temperatures, and avoid loose gathers or folds which catch on machinery or otherwise interfere with work.

Known protective gloves are made from a mass of interlocking metal rings, typically brass or stainless steel. Such meshes, and various methods of making them have been long known. See, for example, expired U.S. Pat. Nos. 948,615 and 1,028,904. Because the wearer's hand is considerably larger in circumference than his wrist, and also because the interlocking ring construction does not permit the mesh to expand, existing mesh gloves include a side opening or slit that extends from the wrist to near the base of the little finger. This side opening allows the glove to open and permits insertion of the user's hand. The glove is then held in place by a strap stitched to the end of the glove and buckled around the user's wrist.

This long-existing glove construction has several disadvantages. The principal disadvantage is that the side opening must be relatively long to permit the wearer's hand to be inserted, but a side opening is unsafe because it leaves a portion of the wearer's hand unprotected even when the glove is buckled in place.

To overcome this problem the protective glove of U.S. Pat. No. 4,471,495 utilizes a wide opening into which the user may stick a hand. A removable strap which is inserted into a cuff then gathers the extra mesh when it is tightened. This construction, however, also presents several problems. First, the removable strap is often not in the glove, thereby rendering the glove unusable. Second, the gathering of the mesh all around the hand, while not exposing the hand to any open areas in the glove, does provide excess material which is bunched and which is capable of catching on a foreign object or otherwise interfere with work when in use.

SUMMARY OF THE INVENTION

Accordingly, the protective glove of the present invention is a metal mesh glove that has no side opening, yet the glove opening is wide enough for the hand of the user to fit inside. The glove includes a slit, and a V-shaped portion of metal mesh is secured to the sides of the slit to enclose a wearer's hand with metal mesh. When a closure strap fastened to the base of the glove is in an open position, the V-shaped portion extends to its full V-shape. When the glove is fastened by tightening and securing the strap, the upper tips of the V-shaped section overlap each other thereby securely and completely closing the glove.

These and other objects and features of the present invention will be more fully understood from following detailed description which should be read in light of the accompanying drawings in which corresponding reference numerals refer to corresponding parts throughout the several views.

DETAILED DESCRIPTION OF THE PREFERRED EMBODIMENTS

Figure 1:
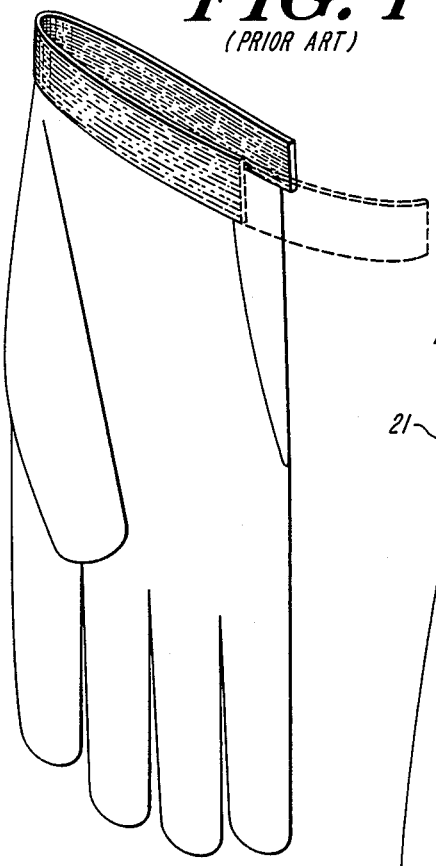
FIG. 1 (PRIOR ART)
FIG. 1 is a perspective view of a prior art glove.
Figure 2:
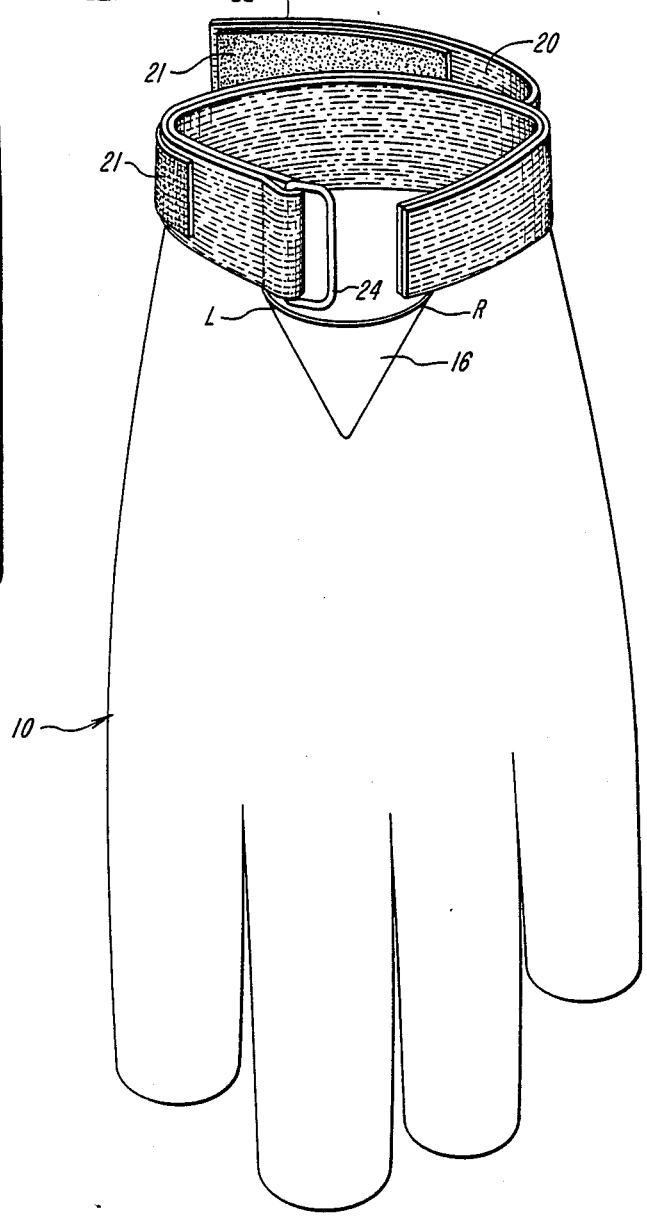
FIG. 2 is a perspective view of the protective glove of the present invention with the closing strap in an opened position.
Figure 4:
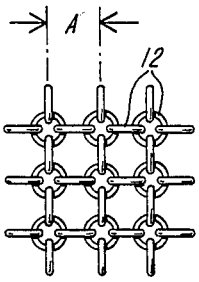
FIG. 4 is a view of a portion of the mesh of the glove of FIGS. 2 and 3.

FIG. 2 shows a protective glove 10 of the present invention made from a mesh of interlocking stainless steel rings. The entire glove is made of interlocking mesh rings 12. The rings are more or less in two planes. As shown in FIG. 4, rings generally parallel to the overall glove surface are shown diagrammatically as circles, and interlocking rings are shown as lines. The mesh is continuous, without slits of gaps other than the wrist opening 14 and the slit into which V-shaped portion 16 fits.

The circumference of the wrist opening 14 is slightly larger than that of the hand-encircling portion of the glove so as to be large enough to permit the user's hand to be inserted through the wrist opening 14 and into the glove 10. The opening is made larger through the use of a V-shaped metal mesh portion 16, which is secured to the side surfaces of a slit which is preferably positioned in the back of the glove 10. The V-shaped portion 16 can be formed as a V-shaped section of metal mesh or as a square shaped section of metal mesh which is gathered and fastened in a V-shape to the sides of the slit. Obviously, a glove having a slit can provide a wider opening than a glove without a slit. The V-shaped portion 16 allows the glove 10 of the present invention to take advantage of a larger opening generally associated with a slit while at the same time completely enclosing a wearer's hand so as to avoid providing an open space in which a scalpel or other sharp object can penetrate as in the case of prior art gloves.

Figure 3:
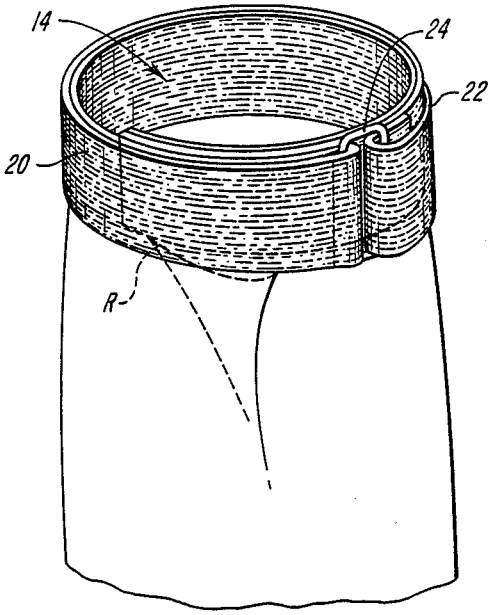
FIG. 3 is a perspective view of a portion of the protective glove shown in FIG. 2 with the closing strap in a closed position.

The strap 20, which is stitched to the end of the glove 10, preferably utilizes a hook and loop fastener 21 and the connecting member 22 passes through loop 24 and back over itself until it is pulled tight with the hook and loop fastener locking to keep the glove in a closed position. When the glove is opened as shown in FIG. 2, the V-shaped portion 16 is fully extended, but when the glove is placed in a closed position as shown in FIG. 3, the right side R (as shown in FIG. 2) of the V-shaped portion 16 as shown in FIG. 2 moves to the left of the left side L of the V-shaped portion 16. This movement of the V-shaped portion 16 is shown in phantom in FIG. 3. As a result, the glove completely encloses the user's hand. In addition, by folding the V-shaped portion 16 over, there is no folding or drooping of the mesh, and the mesh is actually tightened around the wearer's hand.

While the foregoing invention has been described with reference to its preferred embodiments, various alterations and modifications may occur to those skilled in the art. All such alterations and modifications are intended to fall within the scope of the appended claims.

What is claimed is:

1. A protective glove of interlocking metal mesh comprising:

finger and thumb portions arranged to receive the fingers and thumb of a wearer;

a hand portion arranged to receive the hand of a wearer onto which finger and thumb portions are attached, said hand portion including an opening through which the hand, fingers and thumb of the wearer may be inserted into the glove, said hand portion being arranged to extend continuously around the hand of the wearer;

a V-shaped insert fitted in a slit in said hand portion with the wide end of said V-shaped insert being attached to said hand portion at the end of said glove including said opening and with the pointed end of said V-shaped insert being attached at the end of said slit furthest from said opening; said V-shaped insert increasing the diameter of said opening;

means for gathering said hand portion adjacent the opening around the wrist of the wearer, said means for gathering being continuously attached only to an entire edge of said hand portion adjacent said opening.

2. The protective glove of claim 1 wherein said means for gathering comprises a strap connected only to said hand portion of said glove at said opening, said V-shaped insert only being connected to said hand portion of said glove.

3. The protective glove of claim 1 wherein said means for gathering includes means for bringing a first side of said V-shaped insert from one side of a second side of said V-shaped insert to the opposite side of said second side of said V-shaped insert when said glove is tightened around a wrist of a wearer.

4. The protective glove of claim 1 wherein said means for gathering includes a strap adjustable through the use of a hook and loop fastener.

5. In a protective glove of interlocking metal mesh including finger and thumb portions arranged to receive the fingers and thumb of a wearer, and a hand portion arranged to receive the hand of a wearer and to which said finger and thumb portions are attached, said hand portion including an opening through which the hand, fingers and thumb of the wearer may ber inserted into the glove, the improvement comprising:

a hand portion arranged to extend continuously around the hand of the wearer;

a V-shaped insert fitted in a slit in said hand portion with the wide end of said V-shaped insert being attached adjacent said opening of said glove and with the pointed end of said V-shaped insert being attached at the end of said slit furthest from said opening, said V-shaped insert increasing the diameter of said opening;

means for gathering said hand portion adjacent the opening around the wrist of the wearer, said means for gathering being continuously attached only to an entire edge of said hand portion adjacent said opening.

6. The protective glove of claim 5 wherein said means for gathering comprises a strap connected only to said hand portion of said glove at said opening, said V-shaped insert only being connected to said hand portion of said glove.

7. The protective glove of claim 5 wherein said means for gathering includes a means for bringing a first side of said V-shaped insert from one side of a second side of said V-shaped insert to the opposite side of said second side of said V-shaped insert when said glove is tightened around a wrist of a wearer.

8. The protective glove of claim 5 wherein said means for gathering includes a strap adjustable through the use of a hook and loop fastener.

* * * * *